US006817350B2

(12) United States Patent
Miwa et al.

(10) Patent No.: US 6,817,350 B2
(45) Date of Patent: Nov. 16, 2004

(54) IGNITION DEVICE FOR AN INTERNAL COMBUSTION ENGINE

(75) Inventors: Tetsuya Miwa, Nagoya (JP); Atsuya Mizutani, Yokkaichi (JP); Hiromi Hiramatsu, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/621,397

(22) Filed: Jul. 18, 2003

(65) Prior Publication Data

US 2004/0025854 A1 Feb. 12, 2004

(30) Foreign Application Priority Data

Aug. 8, 2002 (JP) ..... 2002-231296

(51) Int. Cl.[7] ..... F02P 13/00
(52) U.S. Cl. ..... 123/634; 336/90
(58) Field of Search ..... 123/634; 336/90

(56) References Cited

U.S. PATENT DOCUMENTS 5,535,726 A 7/1996 Wilmot et al. ..... 123/635
6,119,667 A 9/2000 Boyer et al. ..... 123/634
6,609,508 B2 * 8/2003 Sexton ..... 123/634
6,679,236 B2 * 1/2004 Skinner et al. ..... 123/634
6,694,958 B2 * 2/2004 Hiramatsu et al. ..... 123/634
6,720,854 B2 * 4/2004 Wada et al. ..... 336/90
6,724,289 B2 * 4/2004 Moga et al. ..... 336/90
2002/0195092 A1 * 12/2002 Nagata et al. ..... 123/634
2003/0070665 A1 * 4/2003 Paul et al. ..... 123/634

FOREIGN PATENT DOCUMENTS

EP 907 019 4/1999
JP 2000-277232 10/2000
JP 2002-21695 1/2002

* cited by examiner

*Primary Examiner*—Erick Solis
(74) *Attorney, Agent, or Firm*—Nixon & Vanderhye P.C.

(57) ABSTRACT

An ignition device for an internal combustion engine has a housing, which includes a first case adjacent to the combustion chamber of the engine and a second case away from the combustion chamber. The first case has a flange formed at its end away from the combustion chamber. The second case has a flange formed at its end adjacent to the combustion chamber. The first case flange faces the side of the second case flange that is away from the combustion chamber. A bolt is screwed into the second case to engage the flanges with each other, substantially integrating the cases with each other.

5 Claims, 5 Drawing Sheets

IGNITION DEVICE FOR AN INTERNAL COMBUSTION ENGINE

CROSS REFERENCE TO RELATED APPLICATION

This application relates to and incorporates herein by reference Japanese Patent Application No. 2002-231296 filed on Aug. 8, 2002.

FIELD OF THE INVENTION

The present invention relates to an internal combustion engine ignition device having an ignition plug and an ignition coil that are integrated with each other.

BACKGROUND OF THE INVENTION

An ignition device of this type has a tubular metal housing, which houses the components of an ignition plug and an ignition coil. The housing is comprised of a plurality of cases, which are integrated together by all-around welding (U.S. Pat. No. 6,119,667).

The axial force of the components in the housing causes the tensile load to act on the welded portions of the cases. This requires that the welding strength be sufficient. Consequently, it is essential to control the welding strength.

SUMMARY OF THE INVENTION

It is therefore an object of the present invention is to provide an internal combustion engine ignition device the cases of which do not need welding.

According to the present invention, an ignition device is comprised of an ignition plug, an ignition coil, and a tubular housing that includes a first case adjacent to the combustion chamber and a second case away from the combustion chamber. The first case has a first flange formed at an end thereof away from the combustion chamber. The second case has a second flange formed at an end thereof adjacent to the combustion chamber. The first flange faces a side of the second flange. The housing includes a first housing portion adjacent to the combustion chamber, a second housing portion away from the combustion chamber, and a third housing portion between the first and second housing portions. An ignition plug and the ignition coil includes respective components housed in the first and third housing portions, respectively. A holder is connected to the second housing portion for fixing the components in the housing.

BRIEF DESCRIPTION OF THE DRAWINGS

The above and other objects, features and advantages of the present invention will become more apparent from the following detailed description made with reference to the accompanying drawings. In the drawings.

DETAILED DESCRIPTION OF THE PREFERRED EMBODIMENT

Figure 1:
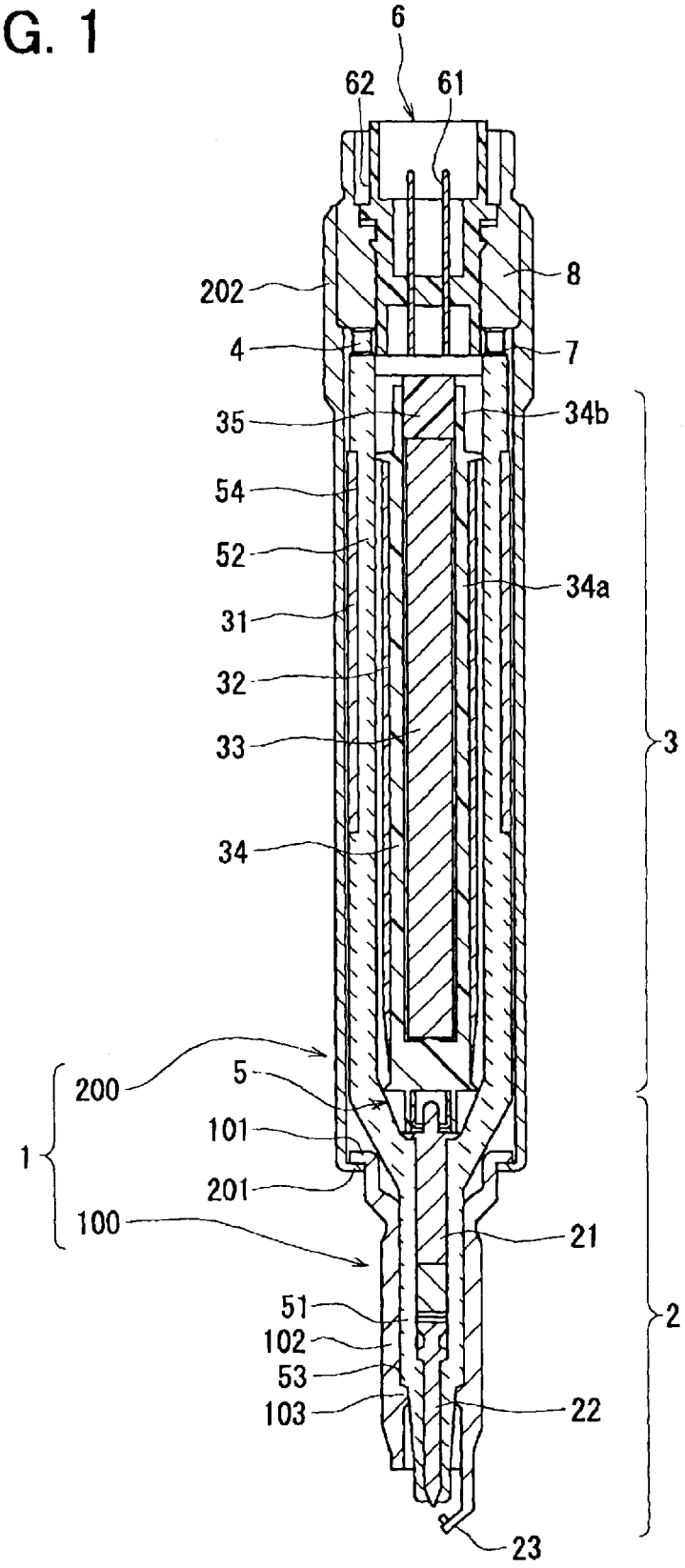
FIG. 1 is a sectional view of an ignition device according to the first embodiment of the present invention.

The present invention will be described in detail with reference to various embodiments shown in the drawings.

(First Embodiment)

An ignition device has a cylindrical housing 1, which houses an ignition plug 2, an ignition coil 3 and a pressure sending element 4. The ignition device can be fitted in a plug hole in the cylinder head of an internal combustion engine (not shown) for a vehicle in such a manner that both center and ground electrodes 22 and 23 of the ignition plug 2 can be exposed to the interior of the combustion chamber of the engine.

The housing 1 is comprised of a lower cylindrical case (first case) 100 and an upper cylindrical case (second case) 200, which are open at both ends. The lower cylindrical case 100 is a plug case, which is adjacent to the combustion chamber. The upper cylindrical case 200 is a coil case, which is away from the combustion chamber. The plug case 100 may be formed of carbon steel or other material that is electrically conductive and easy to forge. The coil case 200 may be formed of silicon steel or other material having a good magnetic characteristic.

The plug case 100 has a discal flange 101 extending radially outward from its top (upper end). The coil case 200 has a discal flange 201 extending radially inward from its bottom (lower end). The plug case flange 101 is positioned on the upper (inner) side of the coil case flange 201. Specifically, the flanges 101 and 201 overlap axially with each other. The flanges 101 and 201 are more adjacent to the combustion chamber than the bottom of a secondary spool 34 of the ignition coil.

Figure 2A:
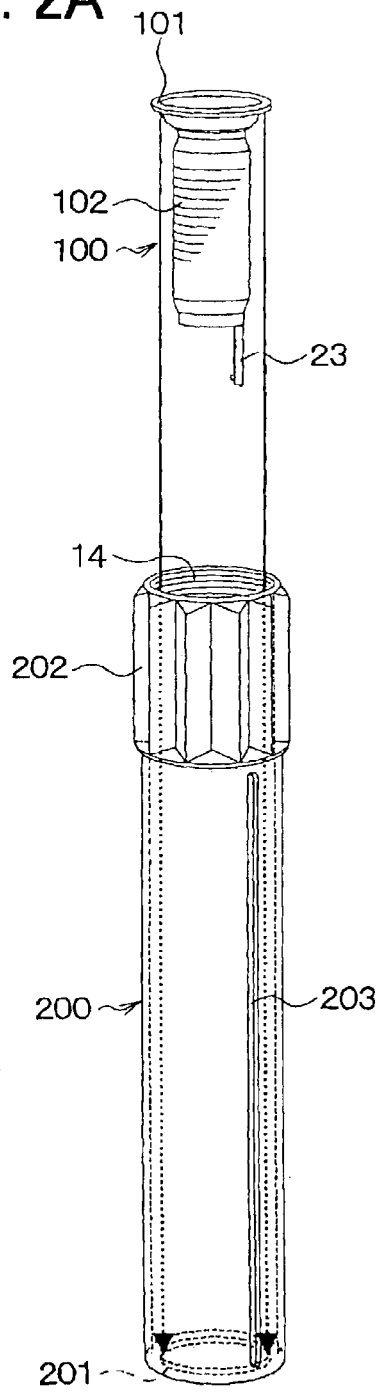
FIG. 2A is an exploded perspective view of the cylindrical cases of FIG. 1.
Figure 2B:
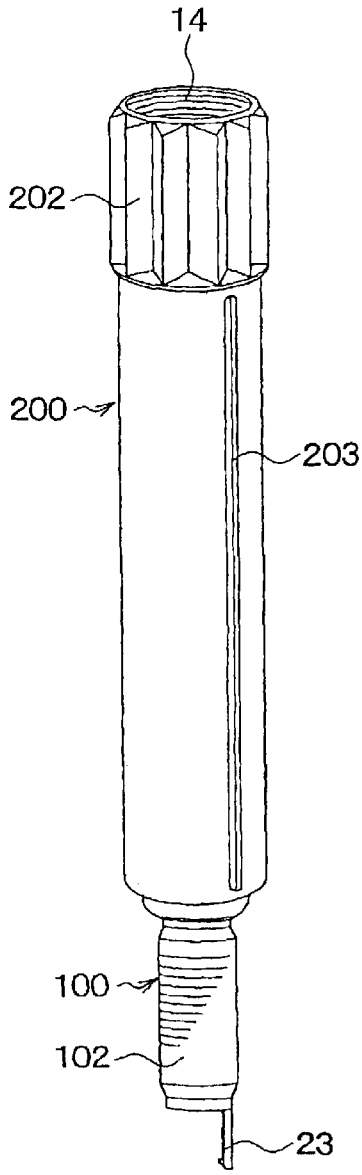
FIG. 2B is a perspective view of the cylindrical cases as assembled.

The plug case 100 has a male thread 102 formed on its outer periphery. As shown in FIGS. 2A and 2B, the top of the coil case 200 has fastening notches 202 formed in its outer periphery for rotating the coil case 200. When the coil case 200 is rotated, the frictional force between the flanges 101 and 201 transmits torque from the coil case 200 to the plug case 100. This engages the male thread 102 with the female thread of the plug hole in the cylinder head so that the ignition device can be fixed to the cylinder head. For more reliable transmission of torque from the coil case 200 to the plug case 100, the flanges 101 and 201 may have irregular or rough contact surfaces, or be wrung and connected together.

The cases 100 and 200 house a cylindrical insulator 5, which may be formed of alumina or another electrically insulating ceramic. The insulator 5 consists of a lower tubular portion 51 and an upper tubular portion 52, which extends upward from the lower tubular portion 51. The tubular portions 51 and 52 are open at both ends.

The plug case 100 has an annular stopper 103 formed on its inner periphery near its bottom. The lower tubular portion 51 of the insulator 5 has an annular step 53 formed at its outer periphery for contact with the upper side of the annular stopper 103. The contact between the annular stopper 103 and the annular step 53 positions the plug case 100 and the insulator 5 axially with respect to each other, and prevents the leakage of combustion gas between the plug case 100 and the insulator 5.

The ignition plug 2 includes a stem 21, a center electrode 22 and a ground electrode 23, all of which are formed of electrically conductive metal. The step 21 and the center electrode 22 are inserted in the center bore of the lower tubular portion 51 or the insulator 5. The bottom of the center electrode 22 can be exposed to the interior of the combustion chamber. The ground electrode 23 is fixed to the housing 1 and may be welded to it. The ground electrode 23 faces the bottom of the center electrode 22.

The ignition coil 3 includes a primary winding 31, a secondary winding 32, a columnar center core 33, which is formed of magnetic material, and a cylindrical secondary spool 34, which is formed of electrically insulating resin. The secondary spool 34 includes a lower tubular portion 34*a* and an upper tubular portion 34*b*. The lower tubular portion 34*a* is open at its top and closed at its bottom. The upper tubular portion 34*b* is open at both ends and protrudes upward from the lower tubular portion 34*a*.

The upper tubular portion 52 of the insulator 5 has an annular recess 54 formed in its outer periphery, onto which the primary winding 31 is wound directly. Both ends of the primary winding 31 are connected through terminals (not shown) to the terminals 61 of a connector 6 so that control signals can be input from an igniter device (not shown) to the primary winding 31.

The coil case 200, which surrounds the primary winding 31, functions as an outer peripheral core. As shown in FIGS. 2A and 2B, the coil case 200 has a slit 203 formed through its cylindrical wall. The slit 203 prevents the losses caused by the loop currents generated by magnetic flux changes.

The secondary winding 32 is wound onto the outer periphery of the lower tubular portion 34*a*. The center core 33 is inserted in the center bore of the secondary spool 34. Thereafter, a closure 35 is inserted in the top of the center bore of the secondary spool 34 to close the center bore. The closure 35 may be formed of rubber, sponge or other elastic material.

The secondary spool 34, which is fitted with the secondary winding 32, the center core 33 and the closure 35, is inserted in the center bore of the upper tubular portion 52 of the insulator 5. Thereafter, while the top of the upper tubular portion 52 is positioned upward, an electrically insulating resin is poured into the top of the upper tubular portion 52. The poured resin flows into the gap between the upper tubular portion 52 and the secondary winding 32, and then hardens to fix this winding 32.

The upper tubular portion 52 of the insulator 5 is filled with the insulating resin at a level not higher than the top of the upper tubular portion 34*b* of the secondary spool 34 so that no resin can flow into the center bore of this spool 34. Besides, the closure 35 of the secondary spool 34 prevents the resin from flowing into the center bore of this spool 34. Accordingly, only the secondary winding 32 is fixed by the insulating resin in the ignition device.

In FIG. 1, the high voltage end of the secondary winding 32 is connected to the center electrode 22 of the ignition plug 2, and the low voltage end of this winding 32 is connected through a terminal (not shown) to the coil case 200, which is grounded through the cylinder head etc. to the vehicle body (not shown).

The electric potential of the pressure sending element 4 changes as the load on it varies. The pressure sending element 4 may be formed of titanate and takes the form of a thin ring. The pressure sending element 4 is positioned at the top of the upper tubular portion 52 of the insulator 5 together with a terminal 7 in the form of a thin ring, which is formed of electrically conductive metal. The terminal 7 is integrated with the connector terminals 61.

In order that the pressure sensing element 4 can be positioned at the top of the upper tubular portion 52 of the insulator 5, this top is higher than the windings 31 and 32. Specifically, the top of the upper tubular portion 52 protrudes above the windings 31 and 32.

As shown in FIGS. 2A and 2B, the top of the coil case 200 has a female thread 14 formed in its inner periphery. The pressure sensing element 4 can be held by a tubular bolt 8 as a holder. The bolt 8 engages with the female thread 14 to hold the pressure sensing element 4 and the terminal 7 between the bolt 8 and the top of the upper tubular portion 52 of the insulator 5.

One end of the pressure sensing element 4 is connected electrically though the bolt 8 to the coil case 200, and the other end is connected electrically to the terminal 7. This allows the pressure sensing element 4 to output signals to a controller (not shown).

The ignition device can be assembled as shown in FIGS. 2A and 2B. First, as shown in FIG. 2A, the plug case 100 is inserted downward into the coil case 200. In the meantime, the stem 21, the center electrode 22, the secondary winding 32, the center core 33, the secondary spool 34, etc. are inserted into the insulator 5 as wound with the primary winding 31. Thereafter, the pressure sensing element 4 and the terminal 7 are fitted in the top of the upper tubular portion 52 of the insulator 5. Next, the insulator 5 is inserted into the cases 100 and 200. Thereafter, the bolt 8 is engaged with the female thread 14 and tightened. Thereafter, the resinous case 62 of the connector 6 is inserted into the bore of the bolt 8.

The axial force of the tightened bolt 8 fixes the components of the ignition plug 2 and ignition coil 3 and the pressure sensing element 4 in the cases 100 and 200. This axial force pushes the plug case 100 downward and pulls the coil case 200 upward. Because the plug case flange 101 faces the upper side of the coil case flange 201, the fastening of the bolt 8 engages the flanges 101 and 201 with each other to substantially integrate the cases 100 and 200 with each other.

The ignition coil 3 generates a high voltage based on the control signals from the igniter. The ignition plug 2 discharges the high voltage in its spark gap to ignite the mixture in the combustion chamber. The pressure developed by the combustion in the combustion chamber is transmitted through the insulator 5 to the pressure sensing element 4. This applies a compressive load on the pressure sensing element 4, which then outputs a signal having a voltage corresponding to the applied load.

Because the fastening of the bolt 8 substantially integrates the cases 100 and 200 together, it is not necessary to weld these cases together and control the welding strength.

Because the materials for the cases 200 and 200 are not limited to ones that can be welded, it is possible to select a suitable material for each of the cases 100 and 200.

For example, the flanges 101 and 201 are lower than the bottom of the secondary spool 34. This means that the components of the ignition coil 3 are positioned within the coil case 200. Accordingly, it is possible to improve the performance of the coil case 200 by selecting for this case a material having a good magnetic characteristic. On the other hand, there is no need to take account of the magnetic characteristic of the plug case 100. Consequently, it is possible to improve the workability of the plug case 100 by selecting for this case a material having high workability.

(Second Embodiment)

Figure 3:
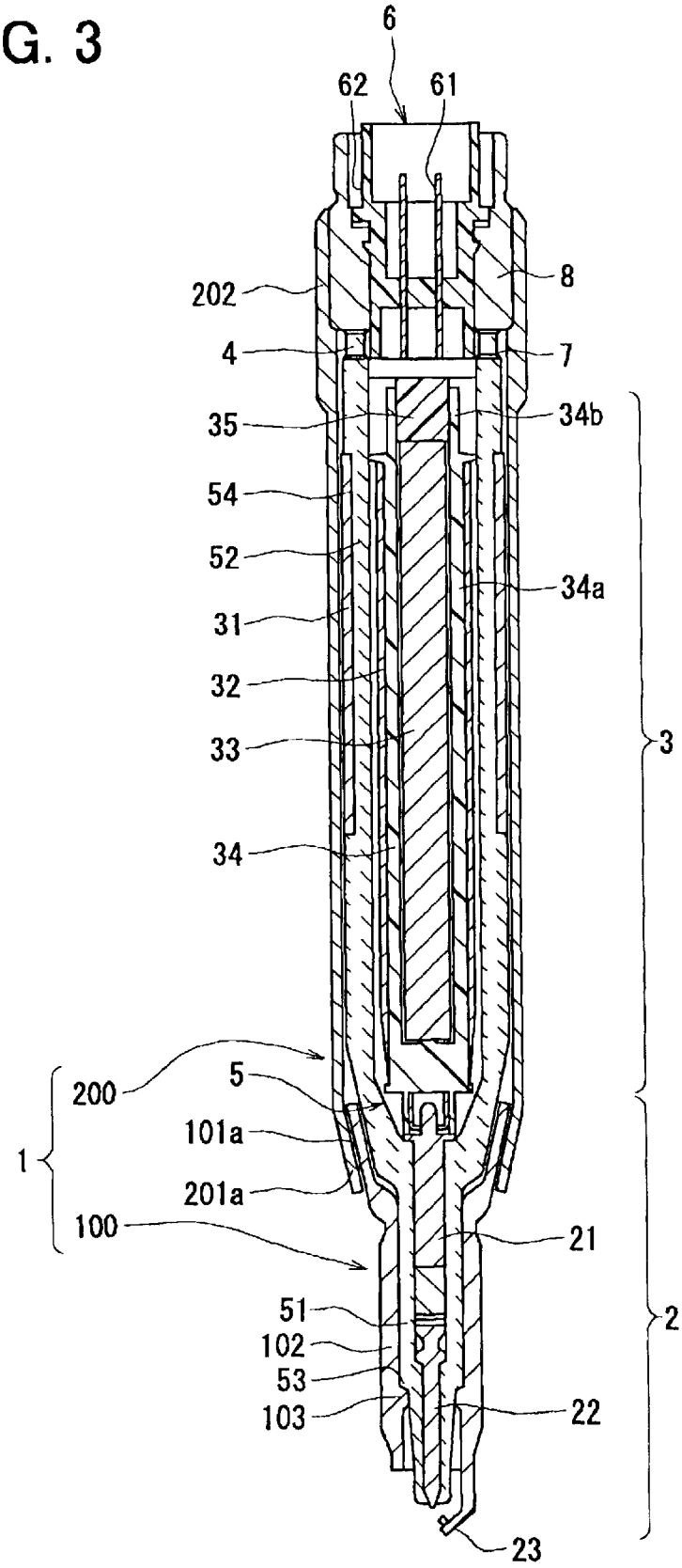
FIG. 3 is a sectional view of an ignition device according to the second embodiment of the present invention.

As shown in FIG. 3, an ignition device for fitting in an internal combustion engine (not shown) has a lower cylindrical case 100 and an upper cylindrical case 200, which are open at both ends. The lower cylindrical case 100 is a plug case, which is adjacent to the combustion chamber of the engine. The upper cylindrical case 200 is a coil case, which is away from the combustion chamber.

The plug case 100 has a conical flange 101*a* diverging upward from its top. The coil case 200 has a conical flange 201*a* converging downward from its bottom. The maximum diameter of the plug case flange 101*a* is larger than the minimum diameter of the coil case flange 201*a*.

The top of the coil case 200 has a female thread formed in its inner periphery for engagement with a tubular bolt 8. The axial force of the bolt 8 being tightened pushes the plug case 100 downward and pulls the coil case 200 upward. This engages the flanges 101*a* and 201*a* with each other to substantially integrate the cases 100 and 200 with each other. Consequently, effects similar to those in the first embodiment can be achieved.

The conical flanges 101*a* and 201*a* are easier to forge than the radial flanges 101 and 201 of the first embodiment.

(Third Embodiment)

Figure 4:
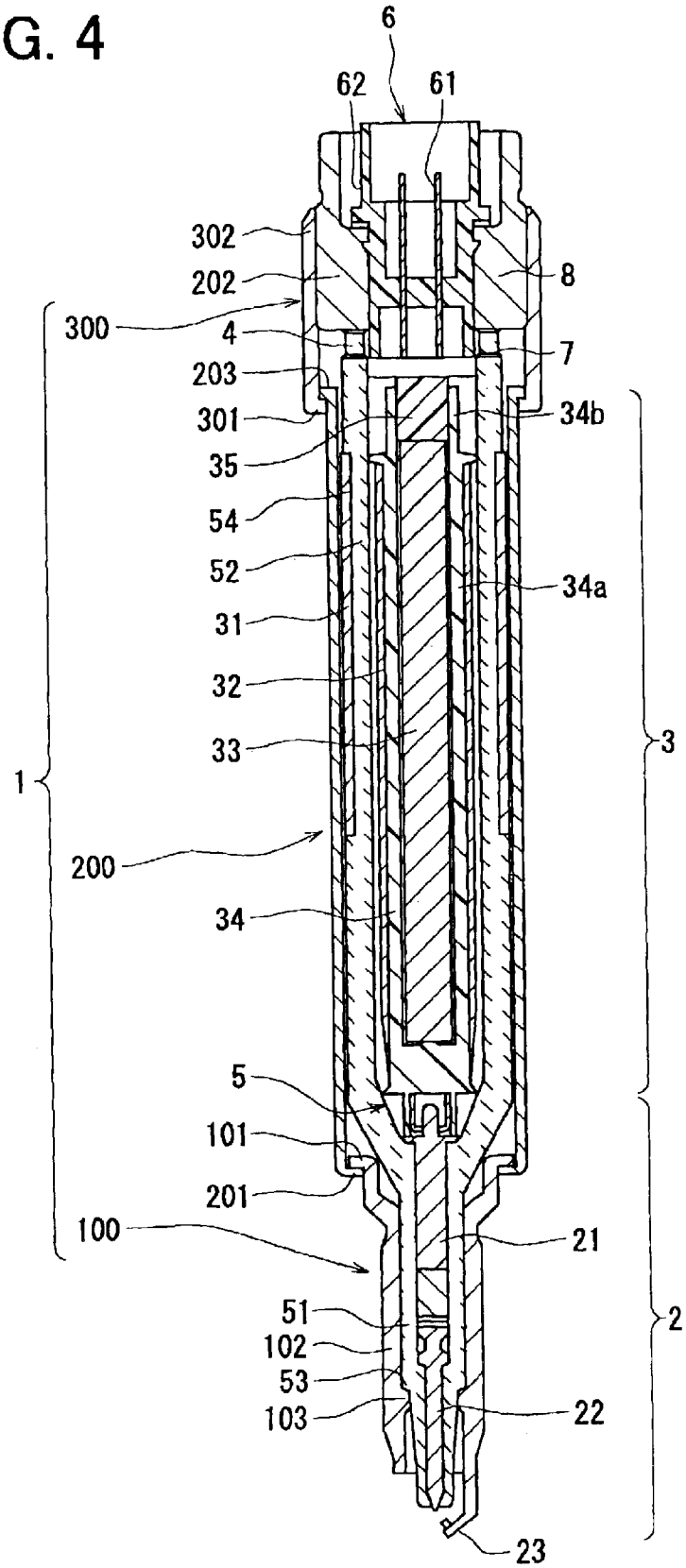
FIG. 4 is a sectional view of an ignition device according to the third embodiment of the present invention.

As shown in FIG. 4, an ignition device for fitting in an internal combustion engine (not shown) has a lower cylindrical case 100, a middle cylindrical case 200 and an upper cylindrical case 300, which are open at both ends. The lower cylindrical case 100 is a plug case, which is adjacent to the combustion chamber of the engine. The upper cylindrical case 300 is a notched case, which is away from the combustion chamber. The middle cylindrical case 200 is a coil case, which is positioned between the other cases 100 and 300. The coil case 200 may be formed of silicon steel or other material having a good magnetic characteristic. The notched case 300 may be formed of carbon steel or other material that is easy to forge.

The plug case 100 has a discal flange 101 extending radially outward from its top. The coil case 200 has a discal flange 201 extending radially inward from its bottom and a discal flange 203 extending radially outward from its top. The notched case 300 has a discal flange 301 extending radially inward from its bottom. The notched case 300 has fastening notches 302 formed in its outer periphery.

The top flange 203 of the coil case 200 faces the upper (inner) side of the flange 301 of the notched case 300. Specifically, the flanges 203 and 301 overlap axially with each other.

The notched case 300 has a female thread formed in its inner periphery for engagement with a tubular bolt 8. The axial force of the bolt 8 being tightened pushes the plug case 100 downward and pulls the coil case 200 and the notched case 300 upward. The top flange 101 of the plug case 100 and the bottom flange 201 of the coil case 200 engage with each other. The top flange 203 of the coil case 200 and the flange 301 of the notched case 300 engage with each other. This substantially integrates the three cases 100, 300 and 300 together. Consequently, effects similar to those in the first embodiment can be achieved.

The housing 1 of this ignition device is divided into three parts. The three cases 100, 200 and 300 are easier to work than the two cases of the first embodiment, into which the associated housing 1 is divided. Besides, these cases 100, 200 and 300 can be assembled better.

(Fourth Embodiment)

Figure 5:
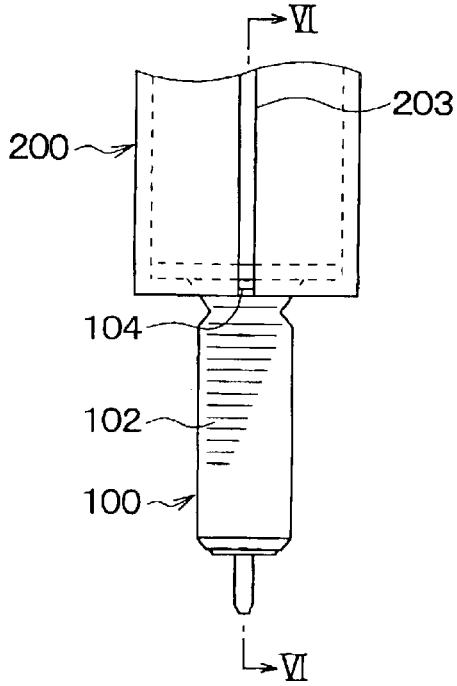
FIG. 5 is a side view of main parts of an ignition device according to the fourth embodiment of the present invention.
Figure 6:
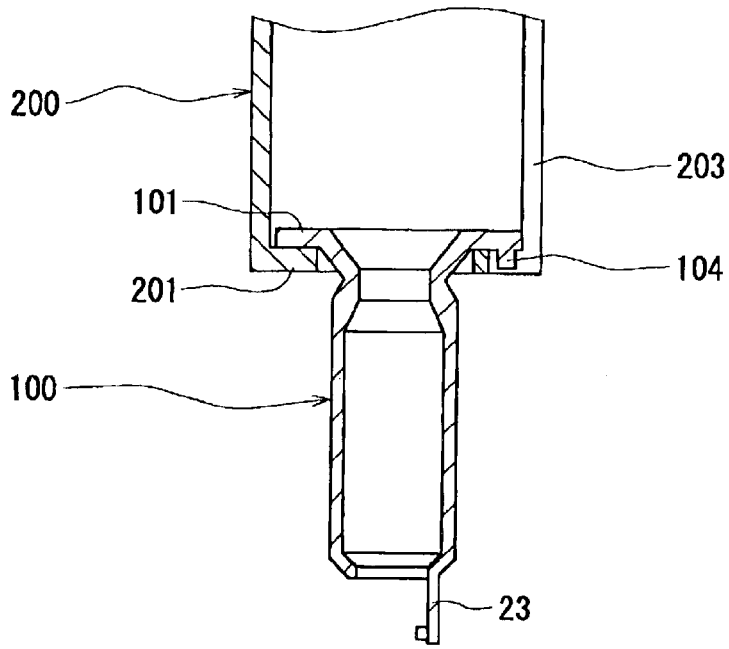
FIG. 6 is a sectional view taken along line VI—VI in FIG. 5.

As shown in FIGS. 5 and 6, an ignition device for fitting in an internal combustion engine (not shown) has a lower cylindrical case 100 and an upper cylindrical case 200, which are open at both ends. The lower cylindrical case 100 is a plug case, which is adjacent to the combustion chamber of the engine. The upper cylindrical case 200 is a coil case, which is away from the combustion chamber.

The plug case 100 has a discal flange 101 extending radially outward from its top. The coil case 200 has a discal flange 201 extending radially inward from its bottom. The plug case flange 101 has a protrusion 104 protruding downward from its lower (outer) side. The coil case 200 also has a slit 203 formed through its cylindrical wall and its flange 201. When the plug case 100 is inserted downward into the coil case 200, the protrusion 104 is engaged with the slit 203.

When this ignition device is fitted to and removed from the engine, the mechanical engagement between the slit 203 and the protrusion 104 transmits torque from the coil case 200 to the plug case 100. This transmission is more reliable than friction transmission.

(Other Embodiments)

In each of the foregoing embodiments, the primary winding 31 is positioned outside the secondary winding 32. Alternatively, the primary winding 31 might be positioned inside the secondary winding 32.

In each of the foregoing embodiments, the axial force of the tightened bolt 8 fixes the components of the ignition plug 2 and ignition coil 3 and the pressure sensing element 4 in the cases 100 and 200. Alternatively, the components of the ignition plug 2 and ignition coil 3 and the pressure sensing element 4 might be fixed in the cases 100 and 200 by means of a non-threaded holder in place of the bolt 8. The holder could be pressed into the coil case 200 to develop an axial force. Alternatively, after inserted into the coil case 200, the holder could be caulked to develop an axial force.

What is claimed is:

1. An ignition device for an internal combustion engine having a combustion chamber, the device comprising:

an ignition plug for discharging in the combustion chamber;

an ignition coil for supplying a high voltage to the ignition plug;

a tubular housing including a first case adjacent to the combustion chamber and a second case away from the combustion chamber; and a holder, wherein the first case has a first flange formed at an end thereof away from the combustion chamber, the second case has a second flange formed at an end thereof adjacent to the combustion chamber, and the first flange faces a side of the second flange that is away from the combustion chamber, wherein the housing includes a first housing portion adjacent to the combustion chamber, a second housing portion away from the combustion chamber, and a third housing portion between the first and second housing portions, wherein the ignition plug and the ignition coil includes respective components housed in the first and third housing portions, respectively, and the holder is connected to the second housing portion for fixing the components in the housing.

2. The ignition device according to claim 1, wherein the ignition coil includes a secondary spool wound with a secondary winding, the first and second flanges are more adjacent to the combustion chamber than the end of the secondary spool that is adjacent to the combustion chamber.

3. The ignition device according to claim 1, wherein each of the first and second cases is formed of a different material.

4. The ignition device according to claim 1, wherein the housing is divided into three or more.

5. An ignition device for an internal combustion engine, comprising:

an ignition plug including components;

an ignition coil including components;

a tubular housing housing the components of the ignition plug and the ignition coil, the housing having an open end; and a holder connected to the open end of the housing, the holder being adapted to exert an axial force for fixing the components of the ignition plug and the ignition coil in the housing, wherein the housing are divided into axially separate cases, the cases having flanges for engaging when the axial force acts.

* * * * *